US008636150B1

(12) United States Patent
Akers, Jr. et al.

(10) Patent No.: US 8,636,150 B1
(45) Date of Patent: Jan. 28, 2014

(54) SCREENING APPARATUS

(75) Inventors: Uriah Shelby Akers, Jr., True, WV (US); Wendell B. Shrewsbury, Matoaka, WV (US); Keith W. Martin, Sr., Rocky Gap, VA (US)

(73) Assignee: Dewar of Virginia, Inc., Princeton, WV (US)

( * ) Notice: Subject to any disclaimer, the term of this patent is extended or adjusted under 35 U.S.C. 154(b) by 294 days.

(21) Appl. No.: 13/177,513

(22) Filed: Jul. 6, 2011

Related U.S. Application Data

(60) Provisional application No. 61/361,809, filed on Jul. 6, 2010.

(51) Int. Cl.
*B07B 1/46* (2006.01)

(52) U.S. Cl.
USPC ..... 209/314; 209/318; 209/413

(58) Field of Classification Search
USPC ..... 209/314, 315, 316, 317, 319, 404, 413, 209/240, 250, 380
See application file for complete search history.

(56) References Cited

U.S. PATENT DOCUMENTS

| | | | | | |
|---|---|---|---|---|---|
| 821,874 | A * | 5/1906 | Kirksey | ..... | 209/314 |
| 860,068 | A * | 7/1907 | Uhland | ..... | 127/25 |
| 3,642,133 | A * | 2/1972 | Venanzetti | ..... | 209/314 |
| 4,065,382 | A * | 12/1977 | Derrick, Jr. | ..... | 209/313 |
| 4,855,039 | A * | 8/1989 | Genev | ..... | 209/311 |
| 6,079,568 | A * | 6/2000 | Loshe | ..... | 209/311 |
| 6,820,748 | B2 * | 11/2004 | Fallon | ..... | 209/311 |
| 6,889,846 | B2 * | 5/2005 | Olsen et al. | ..... | 209/404 |
| 7,278,540 | B2 * | 10/2007 | Stone et al. | ..... | 209/309 |

* cited by examiner

*Primary Examiner* — Joseph C Rodriguez
(74) *Attorney, Agent, or Firm* — Mary-Jacq Holroyd; Johnston Holroyd

(57) ABSTRACT

An upper deck in a top flume before a lower deck in a bottom flume, each deck is adjustable from form about 10 to about 70 degrees, or from about 20 to about 45 degrees, and has a frame divided into a grid containing blank or screen panels that have openings to selectively permit smaller aggregate to pass through, while larger aggregates pass over the screens. The top flume has an opening for feeding the larger aggregates to the top of the deck adjacent the flume, and a bottom with an opening for feeding smaller aggregates under the deck. The bottom flume has an upstream side with an opening at the bottom to receive the smaller aggregates from the upstream adjacent flume and a downstream side having an opening adjacent the bottom of the side to discharge the larger aggregates, and the bottom has an opening it discharge the smaller aggregates.

26 Claims, 11 Drawing Sheets

SCREENING APPARATUS

RELATED APPLICATIONS

This application claims the benefit of U.S. Provisional Application Ser. No. 61/361,809 entitled "SCREENING APPARATUS" filed on Jul. 6, 2010, the contents of which are incorporated herein by reference in its entirety.

BACKGROUND OF THE INVENTION

Screening apparatuses are known in the art. Common uses for screening apparatuses include separating grades of coal. Coal is separated at numerous points including de-slime coal, raw coal, clean coal, and refuse coal. Once coal is mined, the coal is subjected to crushing operations in the presence of water. The crushed coal is fed to a separating apparatus to remove fines and to separate the coal particles according to size. Apparatuses used to separate coal by size typically have dangerous moving parts which vibrate the coal over the screening apparatuses.

Separating devices using screens which use gravity partially, or entirely, in their functioning are known in the art. U.S. Pat. No. 7,571,816B2 teaches an adjustable coal screening apparatus that has an adjustable angle of the device to vary the speed of flow of the coal particles downwardly over the screening assembly; the coal screening apparatus is designed to slow down the flow of coal to allow more coal to go through the screen without damaging the screen. This device is used to dewater the coal particles and to separate partial flows to separate paths by means of an improved screen arrangement, and requires a subsequent separating, or screening apparatus, to separate coal by size in addition to dewatering the coal slurry.

U.S. Pat. No. 4,322,288A teaches an apparatus for sizing particulate material such as grain, seeds and the like which includes a movable diverter disposed between upper and lower sets of screens; the material to be sized is advanced using gravity. This device uses the diverter to direct material through a first sizing screen directed toward and discharge pan and material which has not passed through the first sizing screen is directed to a second sizing screen, so that the material may be separated according to size.

Other devices rely almost exclusively on vibration or sharp movements. For example, U.S. Pat. No. 5,501,343A shows a soil feeding apparatus with interrupter, which departs a sudden inertial shock, and is used to separate soil. U.S. Pat. No. 4,498,981A teaches a vibrating anti-blending cleaning and grading machine to separate grain, seed and like particulate cleaning and grading machine. U.S. Pat. No. 6,575,304B2 teaches a vibrating screen apparatus which minimizes the moving parts therein. U.S. Pat. No. 6,736,269B2 shows a device for collecting and recycling articles directed to feeding channels, and is used to separate tablets, capsules, pills, etc. U.S. Pat. No. 7,168,569B2 teaches a vibratory screening machine for earth drilling installation associated with, for example, oil drilling. U.S. Pat. No. 7,331,469B2 discloses a vibratory separator. U.S. Pat. No. 7,380,672B2 teaches a flow diverter and exhaust blower for vibrating screen separator assembly.

U.S. Pat. No. 1,719,513A teaches a coal screen which vibrates and passes coal from a higher level screen to a lower level screen that serves to permit a change of direction of the stream of coal. U.S. Pat. No. 3,204,764A teaches a coal cleaning apparatus which uses screens and a vibratory mechanism to facilitate cleaning coal. U.S. Pat. No. 7,665,614B2 teaches a screening arrangement in a vibrating screen for screening material. US Patent Application No. 2009026113A1 teaches an extra-large vibrating screen with duplex statically indeterminate mesh bream. The international patent application under the PCT Publication No. WO2009051576A1 teaches a screen mesh and method for resonance excitation thereof.

Great Briton (GB) Patent No. 286,544 teaches improvements in and relating to screens or riddles for use in the classification coal, ores, minerals and the like, in which utilizes graduated size screens subject to shaking or jogging. GB Patent No. 297,330 discloses a clay removing apparatus which utilizes screens and an oscillating motion. GB Patent No. 360,403 teaches improvements relating to jigging mechanisms that is used to jiggle a cleaning table for coal and the like. GB Patent No. 498,523 teaches improvements in and related to the separation of solids from liquids that uses downwardly sloping screens and a vibratory mechanism. GB Patent No. 190913840 teaches improved screen conveyors which were used to screen and size coal, and includes a vibrating device to shake the device. Similarly, GB Patent No. 191122386 shows improvements in coal and like screens and conveyors which also uses jiggling/vibrating screening machinery.

The prior art screening devices have apparatuses designed to shake them. Such shaking apparatuses are inherently dangerous. The possibility of a worker getting caught by the shaking device is a constant concern. Another concern is the possibility of a worker in the process of cleaning a conventional screening device is the danger posed by falling into the screens and becoming caught in the flow of coal or other material to be separated.

SUMMARY OF THE INVENTION

The present invention provides stand alone screening apparatus useful for separating coal including deslime coal, raw coal, clean coal and refuse coal. The present invention is an improvement of the prior art device because it does not require a prescreening or post screening apparatus or an additional deslime unit. The apparatus has no moving parts therefore the device relies primarily on gravity in order to function.

Furthermore, the present invention has an advantage in that it is significantly safer than prior art devices. Safety features of the present invention include the fact that the present invention operates without the need to vibrate the device.

Furthermore, the present invention has a barricade to prevent a worker from falling into the stream of coal while cleaning the screens. The barricade system is disposed at the discharge points. Other safety features will become apparent in the following description of the preferred embodiments.

The elimination of electrical or vibrating springs required to operate conventional devices improves safety of the device. In an embodiment of the present invention, a permanently attached adjustable safety drop step system may be provided for deck maintenance, which extends across the device above the screens.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figure 1:
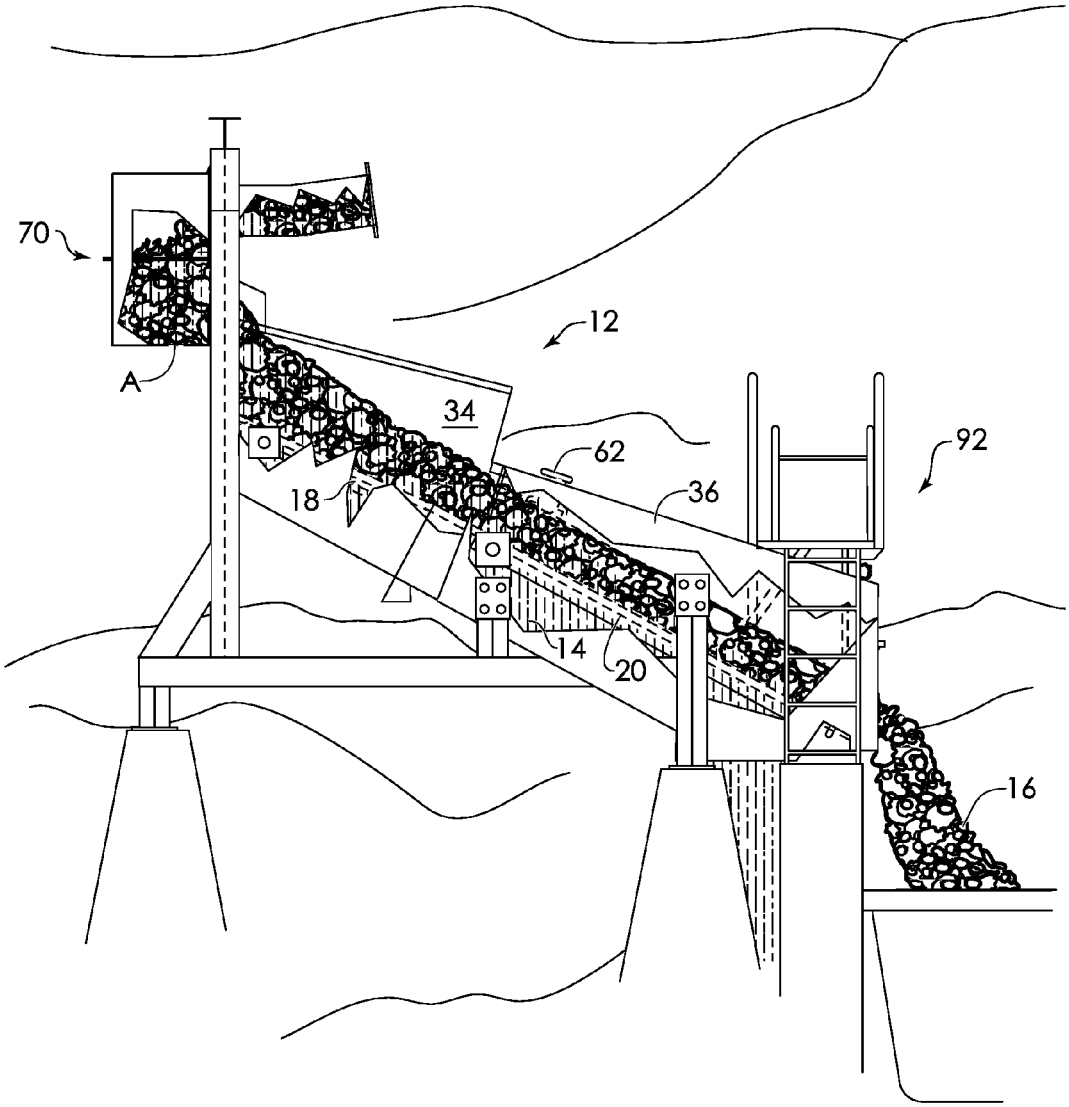
FIG. 1 shows a side environmental view of a screening apparatus according to an alternative embodiment of the present design.

The present invention, shown in detail in FIGS. 1 through 23, provides a standalone screening apparatus 12 useful for separating a stream of aggregate A to separate smaller and larger aggregates into separate collection pathways 14 and 16, as shown in FIG. 1. This design is ideal for the separation of coal including deslime coal, raw coal, clean coal and refuse coal. The present invention is an improvement of the prior art because it does not require a prescreening or post screening apparatus, an additional deslime unit, or a shaking mechanism.

Figure 2:
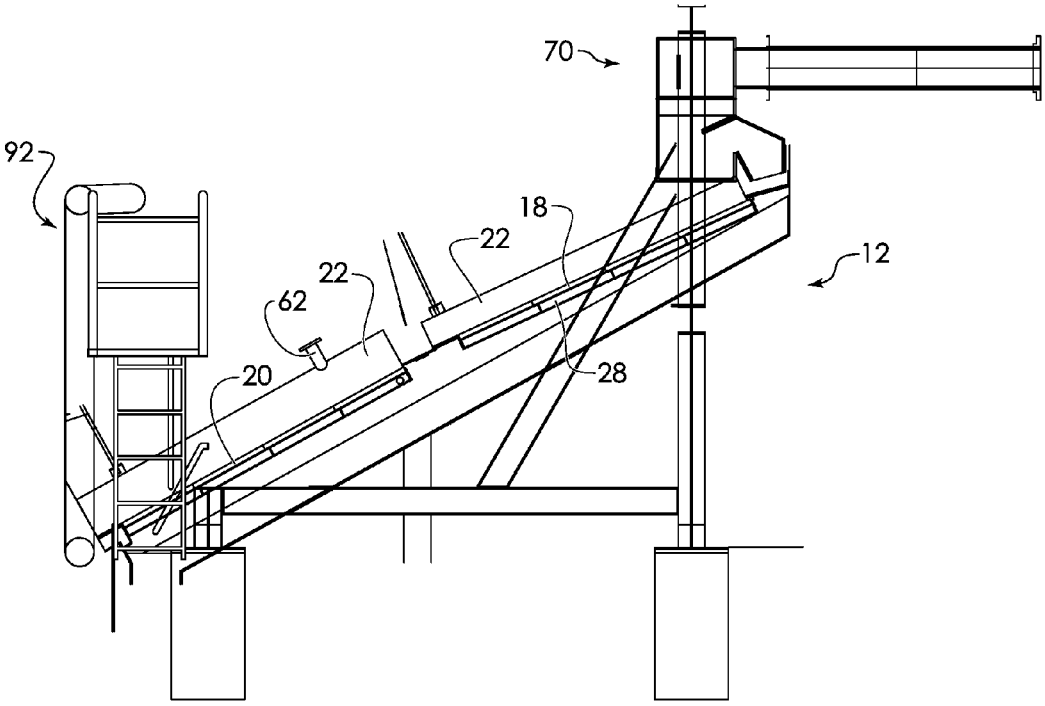
FIG. 2 shows a partial cutaway of a side view showing an alternative layout of screens used with the present design on a stand wherein the feed box is turned to feed above the upper screen.
Figure 3:
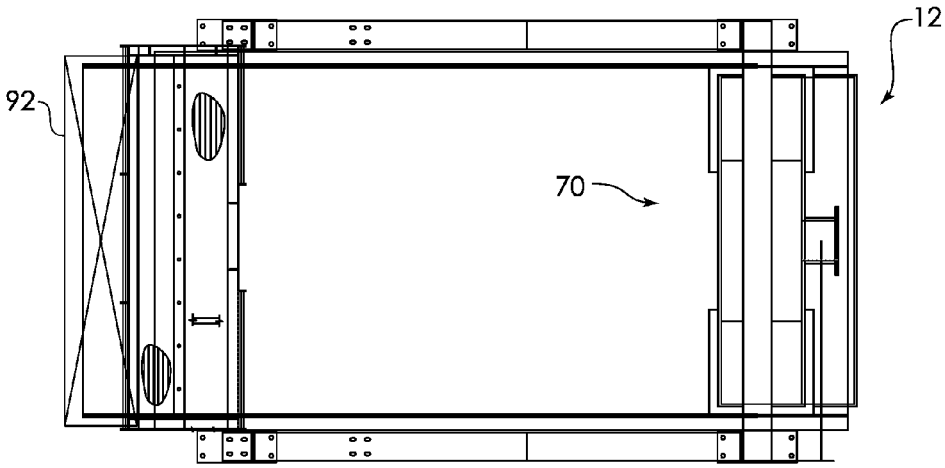
FIG. 3 is a plan view of the screening apparatus showing an alternative location of the walkway relative to the feedbox according to alternative designs where the feed box is fed from above and behind the screening device.
Figure 4:
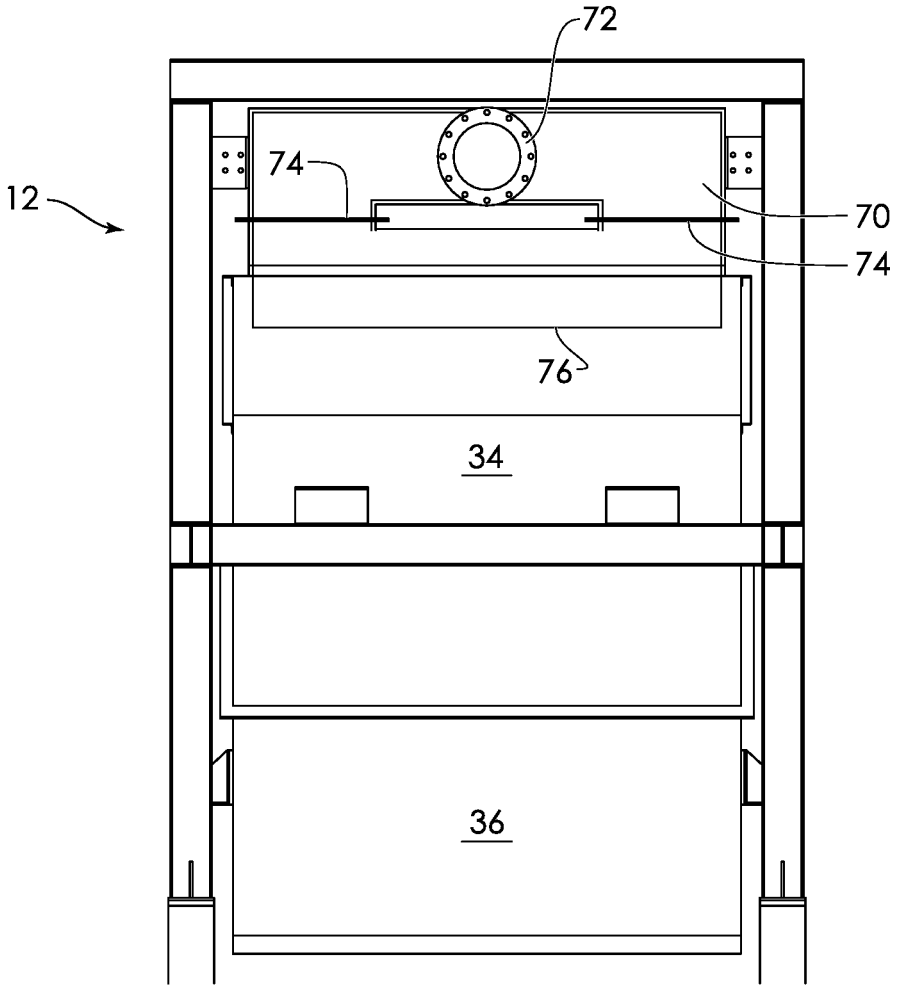
FIG. 4 is a back view of the present design showing an optional frame and the feed box inlet.
Figure 5:
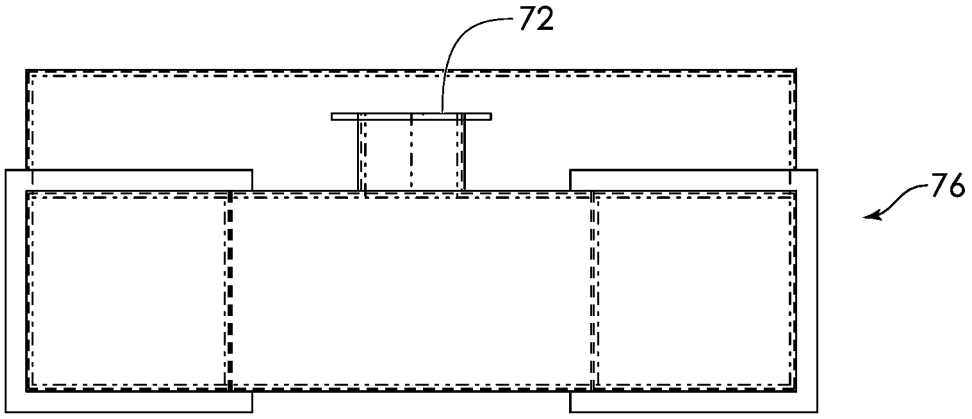
FIG. 5 is a top view of a feed box according to alternative designs.
Figure 6:
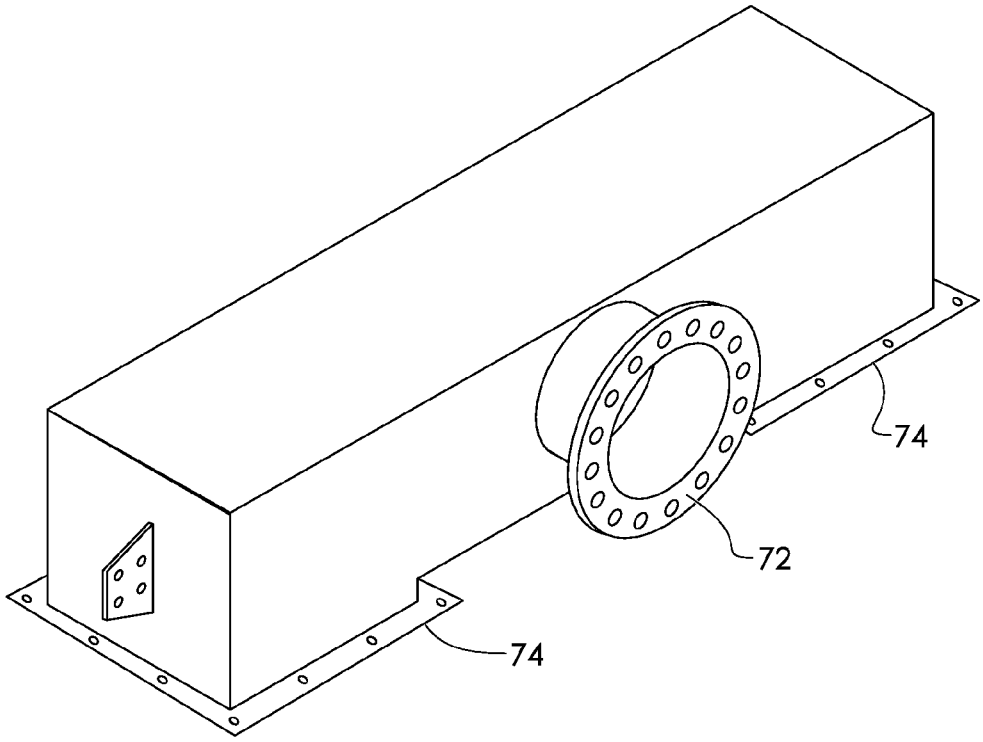
FIG. 6 is a perspective view of the top half of the feed box according to alternative designs.
Figure 7:
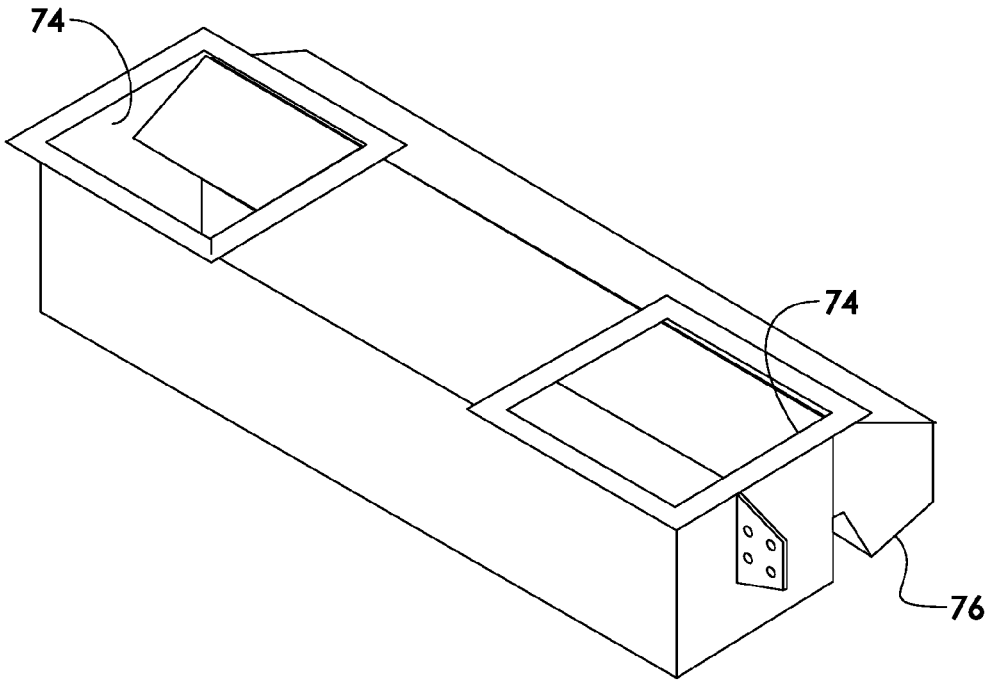
FIG. 7 is a perspective view of the bottom half of the feed box according to the alternative design shown in FIG. 6.
Figure 8:
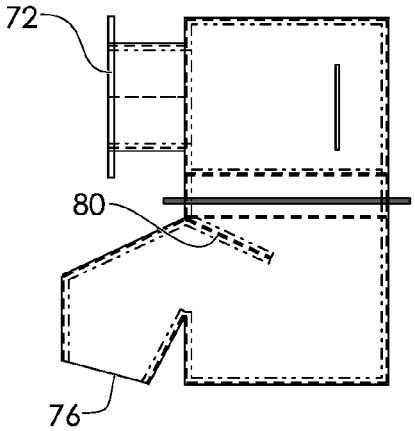
FIG. 8 is a side view of the feed box of FIGS. 6 and 7 put together to form the feeder box according to an alternative design.
Figure 9:
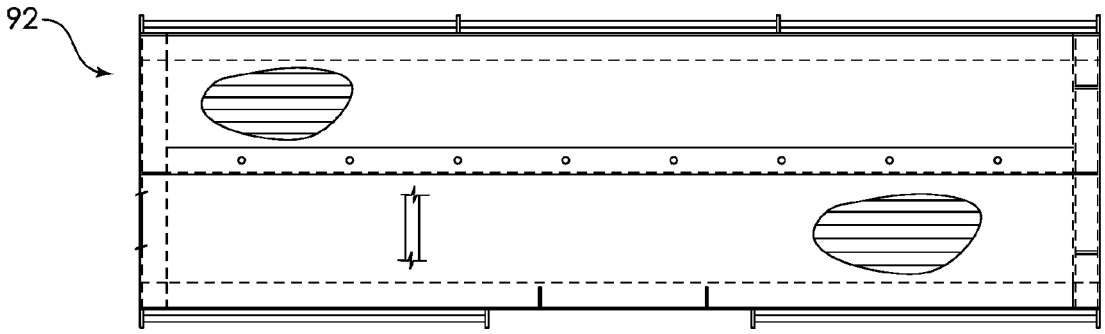
FIG. 9 is an elevated view of a walkway.
Figure 10:
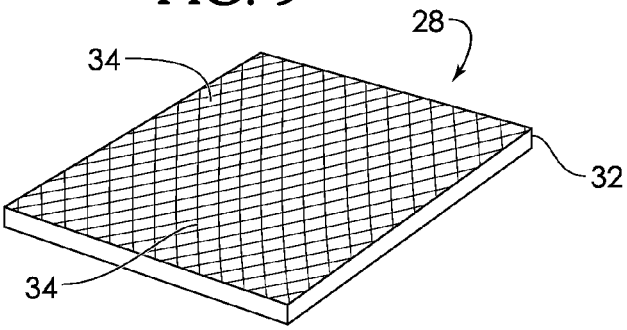
FIG. 10 is an elevated perspective view of a screen panel used with the present design.
Figure 11:
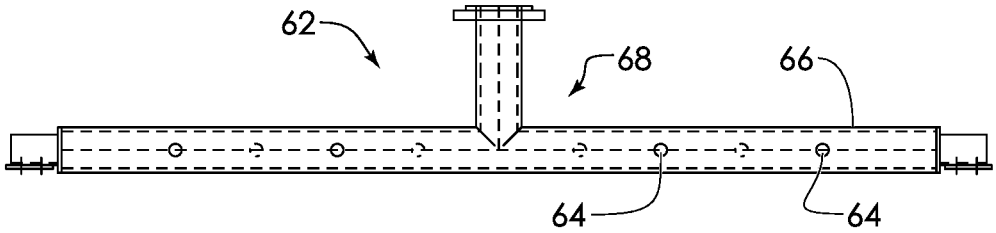
FIG. 11 is a side view of a nozzle spray mechanism according to an alternative embodiment of the present design.
Figure 12:
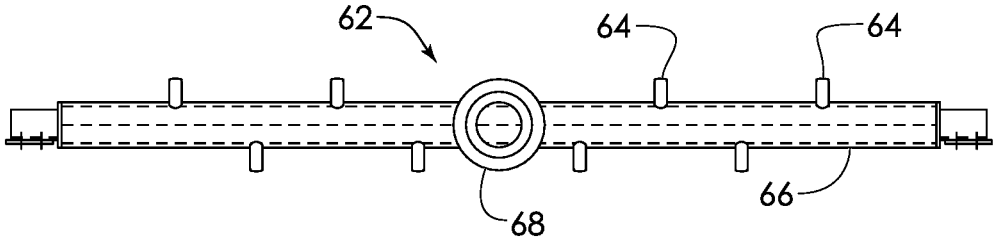
FIG. 12 is an elevated view of the nozzle spray mechanism shown in FIG. 11.
Figure 13:
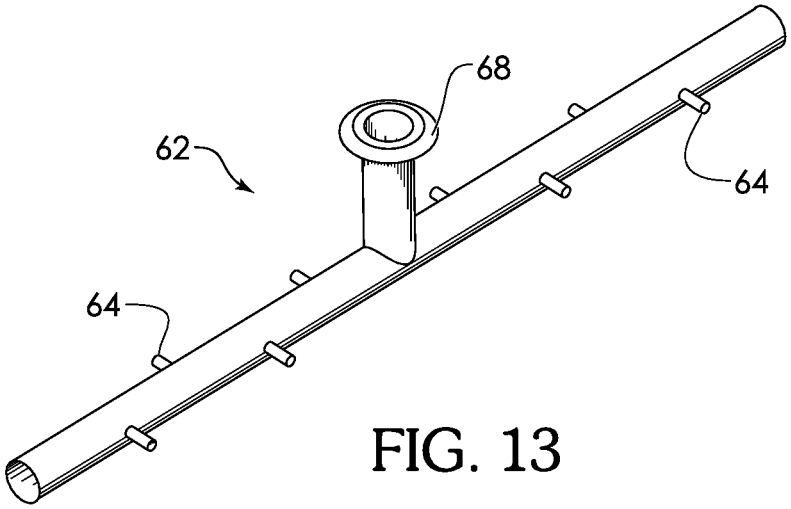
FIG. 13 is an environmental view of the nozzle spray mechanism shown in FIG. 11.
Figure 14:
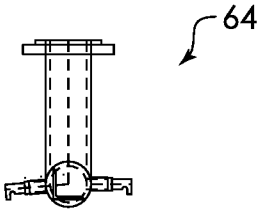
FIG. 14 is a side view of a rotating flange according to the spray mechanism shown in FIG. 11 for receiving water therethrough.
Figure 15:
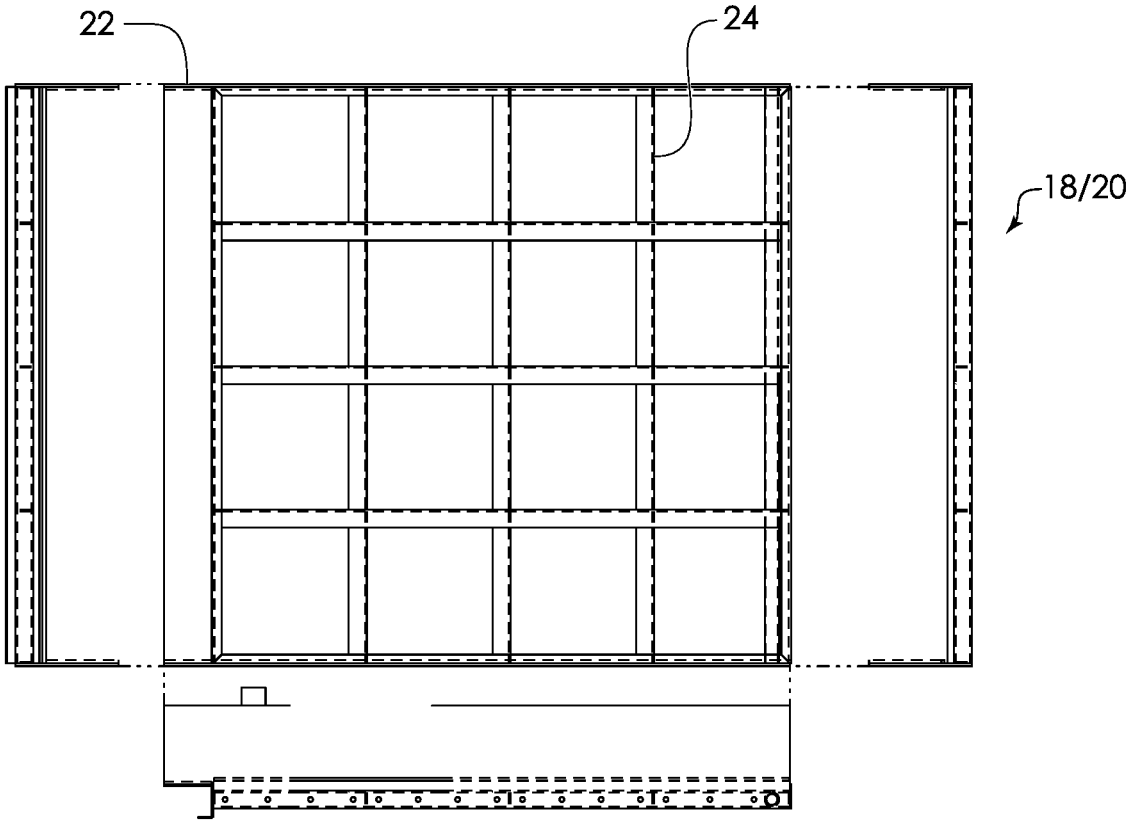
FIG. 15 is an elevated plan view of an embodiment of a screen deck and frame according to alternative embodiments of the present design.

A screening device 12 designed to separate smaller and larger aggregate materials from a mixed aggregate stream A flowing through the screening device 12 from upstream to downstream by force of gravity, as shown most clearly in the environmental view of FIG. 1. The screening device 12 uses at least two decks 18 and 20, with an upper deck 18 disposed before a lower deck 20. The decks 18 or 20 are adjustable from about 10 degrees to about 70 degrees, as shown in FIG. 2. Frequently, the decks 18 or 20 are adjusted from about 20 degrees to about 45 degrees. The decks 18 and 20 are seen most clearly in FIGS. 15 through 18. Each deck 18 or 20 also has a deck frame 22, shown at an angle in FIG. 18. The frame 22 is further divided into a grid 24 with separate openings 26 for receiving a panel 28 therein. Each panel 28 is either an impervious blank 30 or a screen 32. The screens 32 have openings 34 therein, shown in FIG. 10, to selectively permit smaller aggregate to pass through the screen 32 thereunder, while the larger aggregates must pass over the screens 32.

A top flume 34 is provided to affix the upper deck 18 in position, and a bottom flume 36 is provided to affix the lower deck 20 in position. The top flume 34, shown most clearly in FIG. 19, has opposing sides 38, an upstream side 40, and a downstream side 42. An opening 44 is disposed in the downstream side 42 for feeding the larger aggregates to the top of the deck 20 of the adjacent flume 36. The top flume 34 also has a bottom 46 with an opening 48 adjacent the downstream side 42 for feeding the smaller aggregates to the bottom 50 of the adjacent flume 36, shown in FIG. 20, under the deck 20.

The bottom flume 36 has opposing sides 52, an upstream side 54, a downstream side 56, and a bottom 50. The upstream side 54 of the bottom flume 36 has an opening 56 at the bottom 50 to receive the smaller aggregates from the upstream adjacent flume 34 through the opening 48. The downstream side 56 of the bottom flume 36 has an opening 58 adjacent the bottom 50 of the side 56 theretrhough for discharging the larger aggregates. The bottom 50 of the bottom flume 36 has an opening 60 therethrough for discharging the smaller aggregates.

Figure 23:
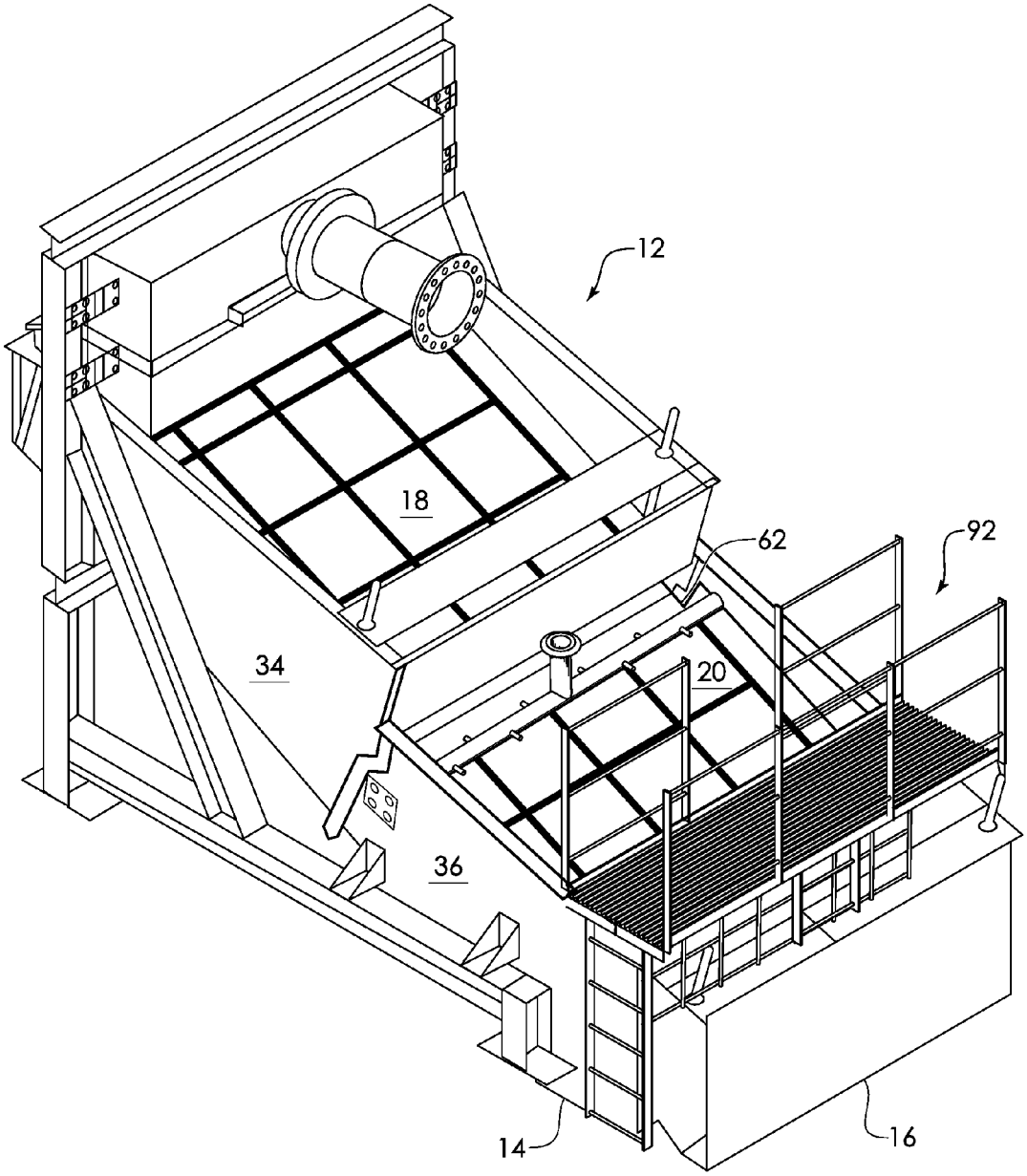
FIG. 23 is an elevated environmental view of an embodiment of the present design with the feeder box positioned to receive aggregated from the front.

A spray bar assembly 62, shown most clearly in FIGS. 11 through 14, has a plurality of spray nozzles 64 in fluid communication with each other disposed above the upper or lower deck 34 or 36, shown in FIGS. 1 and 23, and across the flow of the pathway for the aggregate stream to dispense water across the deck 36. The spray bar 66 has a rotating flange 68 for receiving water therethrough, in alternative designs. The spray nozzles 64 are disposed in at least one line along the bar 64 for discharging water spray across the deck 36. The spray nozzle 64 has adjustable angles and locations relative to the deck 36 thru the X, Y, and Z axis.

A feeder box 70, shown in FIGS. 5 through 8, may be provided according to alternative designs, and disposed to feed the mixed aggregate stream A to the upper deck 34 at the upstream side 40. The feeder box 70 has a single intake 72 to receive the mixed aggregate stream A, and a dual split discharge 74 that feeds the aggregate stream A to a single discharge outlet 76. A ceramic lined feed pipe 78 may be provided to feed aggregate into the single intake 72 of the feeder box 70. An angled barrier 80 may be provided beneath the split discharge 74 to slow down the flow of the aggregate stream A.

Figure 16:
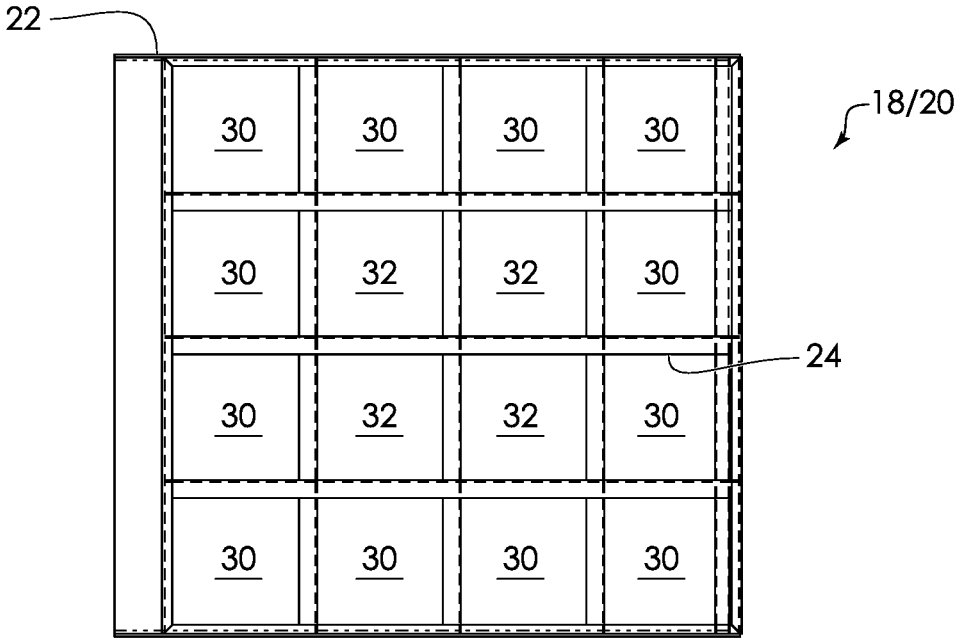
FIG. 16 is an elevated plan view of an embodiment of a screen deck frame according to alternative embodiments of the present design.
Figure 17:
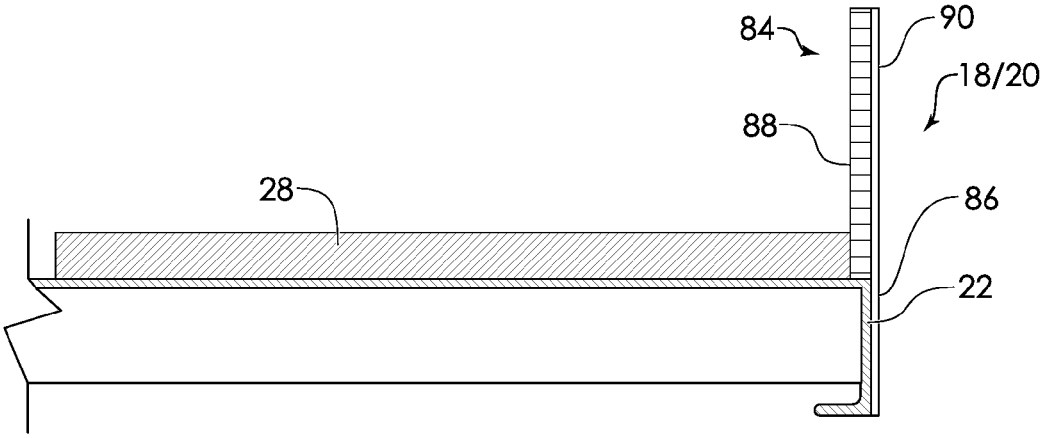
FIG. 17 is a view of the screen frame according to alternative designs showing the side plate.
Figure 18:
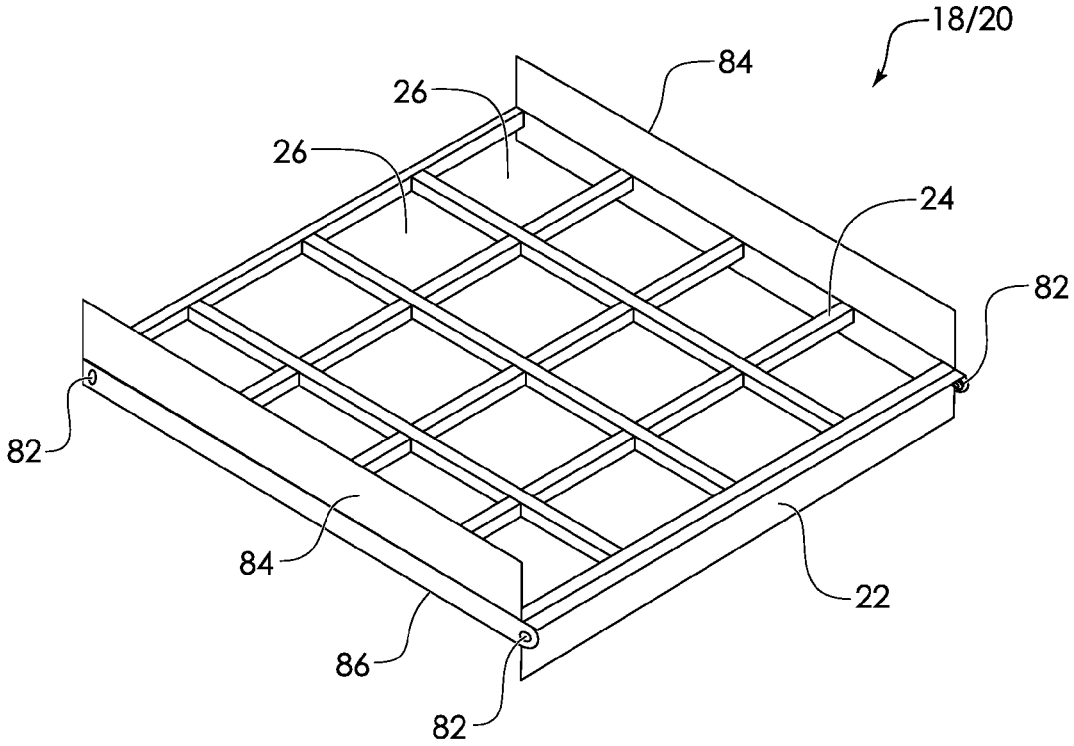
FIG. 18 is an elevated view of a screen frame according to alternative embodiments of the present design showing the opposing side plates.
Figure 19:
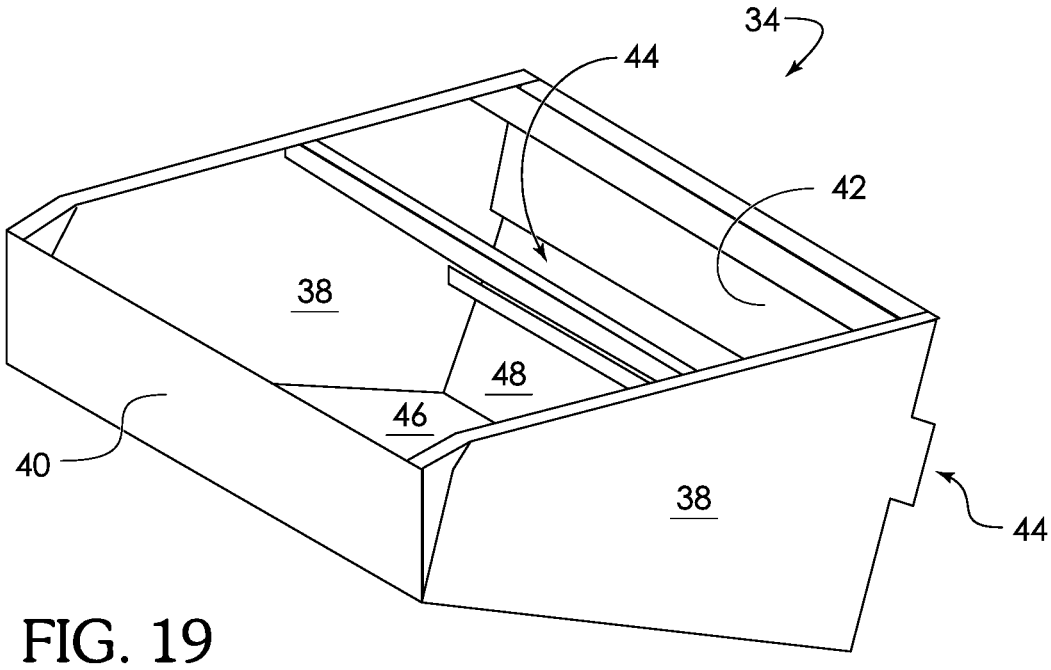
FIG. 19 is an elevated environmental view of an upper flume according to alternative embodiments of the present design.
Figure 20:
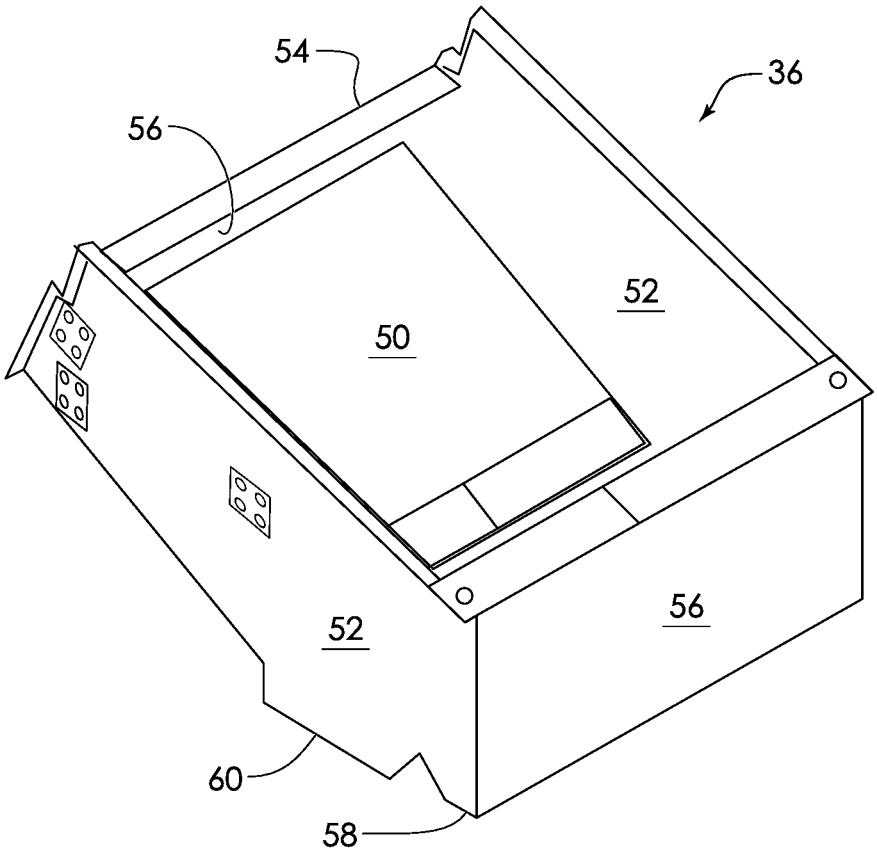
FIG. 20 is an elevated environmental view of a lower flume according to a alternative embodiment of the present design.
Figure 21:
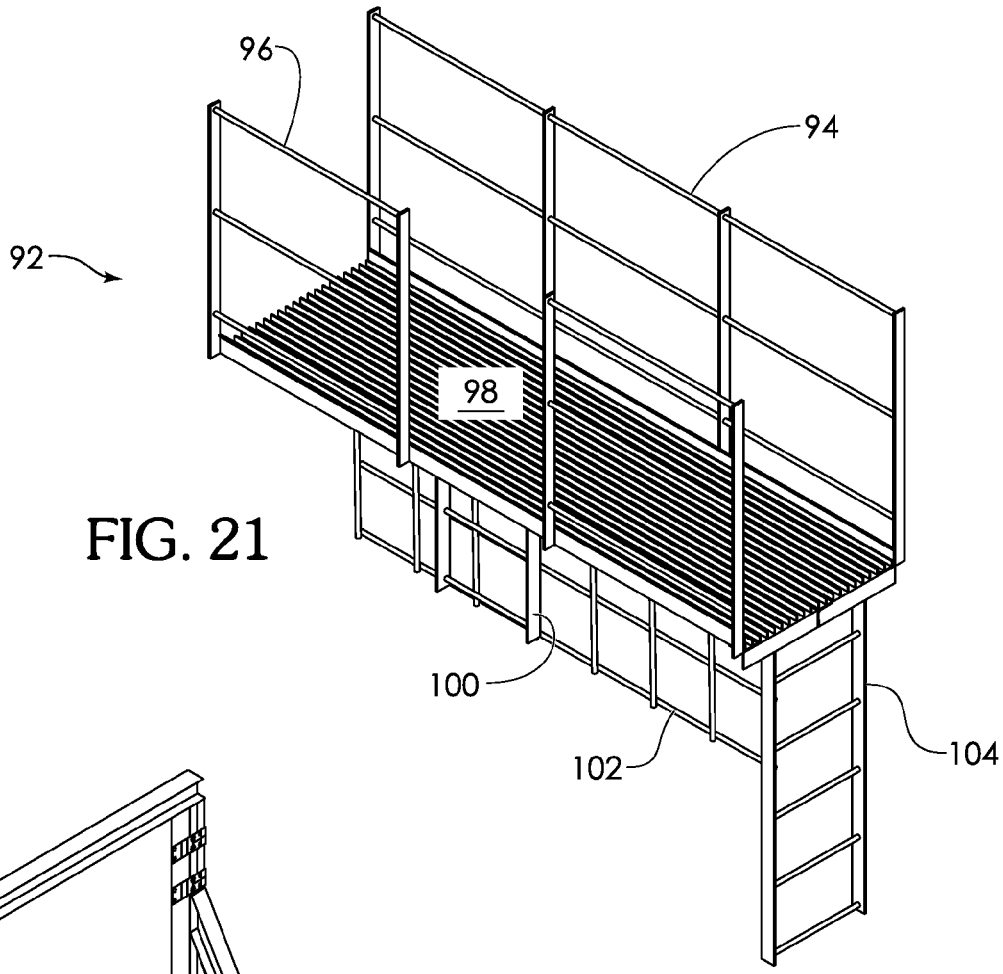
FIG. 21 is an elevated environmental view of a walkway according to an alternative embodiment of the present design.

The decks 18 and 20 may be affixed to the flumes 34 and 36 in various ways, but the most versatile embodiment of the present design permits affixing the decks 18 and 20 in place by using opposing hinges 82 in the sides thereof. In the design of the deck 18/20, side plates 84 may extend upwards from opposing sides 86 of the deck 18 or 20 to channel the stream therebetween. The side plates 84 may have a ceramic tile 88, or ultra high molecular weight or similar plastic tile 88, with or without a backer plate 90 disposed along the sides 86 of the frame 18 or 20. In an embodiment of the present design, the degree of angle can be varied on each deck 18 or 20. Although the panels 28 are shown disposed in a four by four grid in FIGS. 15, 16, and 18, other alternative grid designs may be used. Also, the grids 24 may have a mixture of blank panels 30 and screen panels 32. A desirable configuration of a four by four grid for the upper deck 18, by way of example and shown in FIG. 16, is where the central four panels 28 are screens 32 and the remaining are blanks 32. The decks 18 or 20 can be angled by several different means including mechanical tread jacket, cam lock, electric, air, or hydraulics, as is well known in the art.

In the most preferred embodiments of the present design, and as a major safety feature, a walkway 92 is provided which extends across the bottom flume 36 from side to side. The walkway 92, shown in FIGS. 9 and 21, has railings 94 and 96 disposed along the walkway 92 on both sides. An upstream railing 96 has an opening 98 therein and a ladder 100 extending therefrom for access to the screen deck 20. A fall protection barricade 102 consisting of an open grid grate extends downward beneath the walkway 92 under the downstream railing 94 to prevent someone who is providing maintenance or cleaning from falling into the larger aggregate discharge and being swept away and killed. The walkway 92 may also have a ladder 104 for access to the walkway 92 from the ground where appropriate depending on the lay of the ground.

The unit has multiple screen decks that can be adjusted from about 10 to about 70 degree angles, with angles of about 20 to about 45 degree being generally used. The adjustments are relative to the position of the device so that the decks are adjustable from the absolute horizontal. The spray bar assembly is parallel with the second screen deck with adjustable angles of the spray nozzle and adjustable locations to the screen deck thru the X, Y, and Z axis.

The degrees of angle can be varied on the deck in order to cover the unit if so angled. The deck can be angled by several different means including mechanical tread jacket, cam lock, electric, air or hydraulics.

Figure 22:
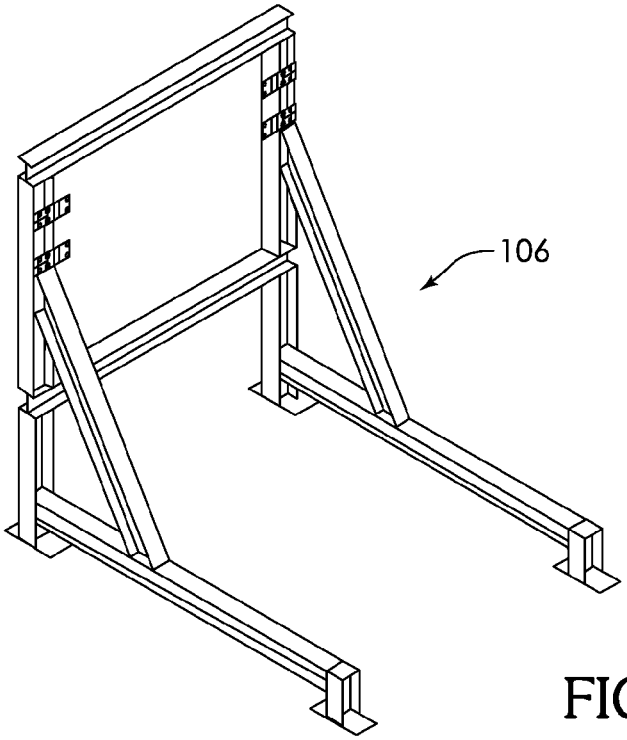
FIG. 22 is an elevated environmental view of an optional stand used to hold the screening device according to alternative embodiments of the present design.

The present invention is described using a flume support stand 106, shown in FIG. 22. Alternative options are available however, and include suspending the support from above. Alternatively, where the ground lies at a proper angle, the frame may be placed directly on the ground.

It is to be understood that the present invention is not limited to the embodiments described above, but encompasses any and all embodiments within the scope of the following claims.

What is claimed is:

1. A screening device for separating smaller and larger aggregate materials from a mixed aggregate stream flowing through the screening device along a path from upstream to downstream by force of gravity, comprising:

at least two decks, with an upper deck disposed upstream before a lower deck disposed downstream of the upper deck, each deck separately adjustable from about 10 to about 70 degrees along the path, and each deck having a deck frame, the frame further divided into a grid with separate openings for receiving a panel therein, wherein each panel is either an impervious blank or a screen, the screens having openings therein to selectively permit smaller aggregate to pass through the screen thereunder, while the larger aggregates must pass over the screens;

such that a path for the aggregate stream is provided over the upper deck and the lower deck permitting smaller aggregate to fall through the screens while larger aggregate remains in the aggregate stream.

2. The screening device of claim 1, further comprising:

adjacent flumes for affixing decks thereon, the flumes disposed along the pathway of the mixed aggregate stream from upstream to downstream; each flume having a bottom and opposing sides forming a pathway for the smaller aggregate between the bottom of the flumes and the decks; the adjacent flumes including a top flume disposed upstream for affixing the upper deck therein, and a bottom flume disposed downstream for affixing the lower deck therein;

the top flume having a bottom, opposing sides, an upstream side, and a downstream side, the downstream side of the top flume having an opening therethrough for feeding the larger aggregates to the top of the deck of the adjacent flume; and a bottom with an opening under the downstream side for feeding the smaller aggregates to the bottom of the adjacent flume under the deck thereof; and the bottom flume having a bottom, opposing sides, an upstream side, and a downstream side; the upstream side of the bottom flume having an opening at the bottom of the adjacent flume to receive the smaller aggregates from the upstream adjacent flume and the downstream side having an opening adjacent the bottom of the bottom flume therethrough for discharging the larger aggregates; and the bottom of the bottom flume having an opening therethrough adjacent the downstream side of the bottom flume for discharging the smaller aggregates.

3. The screening device of claim 1, further comprising:

a spray bar assembly comprising a plurality of spray nozzles in fluid communication with each other disposed above the upper or lower deck, across the pathway for the aggregate stream to dispense water across the deck.

4. The screening device of claim 3, wherein:

the spray bar has a rotating flange for receiving water therethrough;

the spray nozzles are disposed in a line along the bar for discharging water spray across the deck;

the spray nozzle has adjustable angles and locations relative to the deck thru the X, Y, and Z axis; or combinations thereof.

5. The screening device of claim 1, further comprising:

side plates extending upwards from opposing sides of the deck for channeling the stream therebetween.

6. The screening device of claim 5, wherein:

the side plates have a ceramic or plastic tile disposed along the sides of the frame; or the side plates have a ceramic or plastic tile with a backer plate disposed along the sides of the frame.

7. The screening device of claim 1, further comprising:

a feeder box disposed to feed the mixed aggregate stream to the upper deck at the upstream side.

8. The screening device of claim 7, wherein:

the feeder box has a single intake to receive the mixed aggregate stream, a dual split discharge, and a single discharge outlet.

9. The screening device of claim 8, further comprising:
a ceramic lined feed pipe provided to feed aggregate into the single intake of the feeder box;
an angled barrier may be provided beneath the split discharge to slow down the flow of the aggregate stream; or
combinations thereof.

10. The screening device of claim 1, wherein:
the degree of angle can be varied on each deck;
the degree of angle is from 20 to 45 degrees;
the panels are disposed in a four by four grid where the central four panels are screens and the remaining are blanks;
the deck can be angled by several different means including mechanical tread jacket, cam lock, electric, air, or hydraulics; or
combinations thereof.

11. The screening device of claim 2, further comprising:
a walkway extending across the bottom flume from side to side, with railings disposed along the walkway, the upstream railing having an opening therein and a ladder extending therefrom for access to the screen deck
a fall protection barricade consisting of an open grid grate extending downward beneath the walkway under the downstream railing to prevent a user from falling into the larger aggregate discharge;
the walkway further comprising a ladder for access to the walkway; or
combinations thereof.

12. The screening device of claim 2, wherein:
the flumes are disposed on
a flume support stand which holds the flumes in position providing support from the floor,
a flume support stand suspended from above; or
angled ground.

13. The screening device of claim 2, wherein:
the deck is affixed to the flume by opposing hinges in the sides thereof;
the at least two decks are merged forming one deck at an angle thereof; or
combinations thereof.

14. A screening device for separating smaller and larger aggregate materials from a mixed aggregate stream flowing through the screening device from upstream to downstream by force of gravity, comprising:
at least two decks, with an upper deck disposed upstream before a lower deck disposed downstream of the upper deck, each deck separately adjustable from about 10 to about 70 degrees, and each deck having a deck frame, the frame further divided into a grid with separate openings for receiving a panel therein, wherein each panel is either an impervious blank or a screen, the screens having openings therein to selectively permit smaller aggregate to pass through the screen thereunder, while the larger aggregates must pass over the screens; such that a path for the aggregate stream is provided over the upper deck before the lower deck so that when used smaller aggregate falls through the screens while the larger aggregate remains in the aggregate stream;
adjacent flumes for affixing decks thereon, the flumes disposed along the pathway of the mixed aggregate stream from upstream to downstream; each flume having a bottom and opposing sides forming a pathway for the smaller aggregate between the bottom of the flumes and the decks; the adjacent flumes including a top flume disposed upstream for affixing the upper deck therein, and a bottom flume disposed downstream for affixing the lower deck therein;
the top flume having a bottom, opposing sides, an upstream side, and a downstream side, the downstream side of the top flume having an opening therethrough for feeding the larger aggregates to the top of the deck of the adjacent flume; and a bottom with an opening under the downstream side for feeding the smaller aggregates to the bottom of the adjacent flume under the deck thereof; and
the bottom flume having a bottom, opposing sides, an upstream side, and a downstream side; the upstream side of the bottom flume having an opening at the bottom of the adjacent flume to receive the smaller aggregates from the upstream adjacent flume and the downstream side having an opening adjacent the bottom of the bottom flume therethrough for discharging the larger aggregates; and the bottom of the bottom flume having an opening therethrough adjacent the downstream side of the bottom flume for discharging the smaller aggregates.

15. The screening device of claim 14, further comprising:
a spray bar assembly comprising a plurality of spray nozzles in fluid communication with each other disposed, above the upper or lower deck, across the pathway for the aggregate stream to dispense water across the deck; wherein:
the spray bar has a rotating flange for receiving water therethrough,
the spray nozzles are disposed in a line along the bar for discharging water spray across the deck,
the spray nozzle has adjustable angles and locations relative to the deck thru the X, Y, and Z axis; or
combinations thereof.

16. The screening device of claim 14, further comprising:
side plates extending upwards from opposing sides of the deck for channeling the stream therebetween, wherein:
the side plates have a ceramic or plastic tile disposed along the sides of the frame; or
the side plates have a ceramic or plastic tile with a backer plate disposed along the sides of the frame.

17. The screening device of claim 14, further comprising:
a feeder box disposed to feed the mixed aggregate stream to the upper deck at the upstream side; wherein:
the feeder box has a single intake to receive the mixed aggregate stream,
a dual split discharge, and
a single discharge outlet; further comprising:
a ceramic lined feed pipe provided to feed aggregate into the single intake of the feeder box.

18. The screening device of claim 14, wherein:
the degree of angle can be varied on each deck;
the degree of angle is from 20 to 45 degrees;
the panels are disposed in a four by four grid where the central four panels are screens and the remaining are blanks;
the deck can be angled by several different means including mechanical tread jacket, cam lock,
electric, air, or hydraulics; or
combinations thereof.

19. The screening device of claim 14, further comprising:
a walkway extending across the bottom flume from side to side, with railings disposed along the walkway, the upstream railing having an opening therein and a ladder extending therefrom for access to the screen deck
a fall protection barricade consisting of an open grid grate extending downward beneath the walkway under the downstream railing to prevent a user from falling into the larger aggregate discharge;

the walkway further comprising a ladder for access to the walkway; or combinations thereof.

20. The screening device of claim 14, wherein:

the deck is affixed to the flume by opposing hinges in the sides thereof.

21. A method of using a screening device, comprising:

feeding a mixed aggregate onto a screening device to separate the mixed aggregate into smaller and larger aggregate materials in which the aggregate stream flows through the screening device from upstream to downstream by force of gravity;

screening the mixed aggregated by allowing the aggregate stream to flow over the screening device, in which the screening device has at least two decks, with an upper deck disposed upstream before a lower deck disposed downstream of the upper deck, each deck separately adjustable from about 10 to about 70 degrees, and each deck having a deck frame, the frame further divided into a grid with separate openings for receiving a panel therein, wherein each panel is either an impervious blank or a screen, the screens having openings therein to selectively permit smaller aggregate to pass through the screen thereunder, while the larger aggregates must pass over the screens;

such that a path for the aggregate stream is provided over the upper deck before the lower deck so that when used smaller aggregate falls through the screens while the larger aggregate remains in the aggregate stream;

adjacent flumes for affixing decks thereon, the flumes disposed along the pathway of the mixed aggregate stream from upstream to downstream; each flume having a bottom and opposing sides forming a pathway for the smaller aggregate between the bottom of the flumes and the decks; the adjacent flumes including a top flume disposed upstream for affixing the upper deck therein, and a bottom flume disposed downstream for affixing the lower deck therein;

the top flume having a bottom, opposing sides, an upstream side, and a downstream side, the downstream side of the top flume having an opening therethrough for feeding the larger aggregates to the top of the deck of the adjacent flume; and a bottom with an opening under the downstream side for feeding the smaller aggregates to the bottom of the adjacent flume under the deck thereof; and the bottom flume having a bottom, opposing sides, an upstream side, and a downstream side; the upstream side of the bottom flume having an opening at the bottom of the adjacent flume to receive the smaller aggregates from the upstream adjacent flume and the downstream side having an opening adjacent the bottom of the bottom flume therethrough for discharging the larger aggregates; and the bottom of the bottom flume having an opening therethrough adjacent the downstream side of the bottom flume for discharging the smaller aggregates; and discharging the larger aggregates and the smaller aggregates into separate pathways.

22. The method of claim 20, further comprising:

washing the aggregate stream by a spray bar assembly comprising a plurality of spray nozzles in fluid communication with each other disposed, above the upper or lower deck, across the pathway for the aggregate stream to dispense water across the deck; wherein:

the spray bar has a rotating flange for receiving water therethrough, the spray nozzles are disposed in a line along the bar for discharging water spray across the deck, the spray nozzle has adjustable angles and locations relative to the deck thru the X, Y, and Z axis; or combinations thereof.

23. The method of claim 21, further comprising:

channeling the stream between side plates extending upwards from opposing sides of the deck.

24. The method of claim 21, wherein:

a feeder box is disposed to feed the mixed aggregate stream to the upper deck at the upstream side; wherein:

the feeder box has a single intake to receive the mixed aggregate stream, a dual split discharge, and a single discharge outlet; further comprising:

a ceramic lined feed pipe provided to feed aggregate into the single intake of the feeder box.

25. The method of claim 21, wherein:

the degree of angle can be varied on each deck;

each deck is adjustable from about 20 to about 45 degrees;

the panels are disposed in a four by four grid where the central four panels are screens and the remaining are blanks;

the deck can be angled by several different means including mechanical tread jacket, cam lock, electric, air, or hydraulics; or combinations thereof.

26. The method of claim 21, further comprising:

a walkway extending across the bottom flume from side to side, with railings disposed along the walkway, the upstream railing having an opening therein and a ladder extending therefrom for access to the screen deck a fall protection barricade consisting of an open grid grate extending downward beneath the walkway under the downstream railing to prevent a user from falling into the larger aggregate discharge;

the walkway further comprising a ladder for access to the walkway; or combinations thereof.

* * * * *